US005222419A

United States Patent [19]

Spector

[11] Patent Number: 5,222,419

[45] Date of Patent: Jun. 29, 1993

[54] ADJUSTABLE END WRENCH INCLUDING MOVABLE JAW LOCKING MEANS

[76] Inventor: Samuel Spector, 14 Brookfall Rd., Edison, N.J. 08817

[21] Appl. No.: 912,324

[22] Filed: Jul. 13, 1992

[51] Int. Cl.[5] ..... B25B 13/16

[52] U.S. Cl. ..... 81/165; 81/170

[58] Field of Search ..... 81/165, 166, 170, 157, 81/158, 167, 173-176

[56] References Cited

U.S. PATENT DOCUMENTS 1,076,793 10/1913 Seipel ..... 81/165

FOREIGN PATENT DOCUMENTS 18926 of 1907 United Kingdom ..... 81/165

*Primary Examiner*—D. S. Meislin

*Attorney, Agent, or Firm*—Henry I. Schanzer; Michael Y. Epstein

[57] ABSTRACT

A wrench of a conventional worm gear-rack mechanism type includes a fixed jaw and a movable jaw adjustable by means of a worm gear in driving engagement with a rack mechanism of the movable jaw. The rack mechanism is movable within a slot extending through the fixed jaw; the slot being disposed to one side of an object gripping surface of the fixed jaw and along an axis perpendicular to the gripping surface. For locking the movable jaw in position when an object is being gripped between the two jaws, the movable jaw is provided with a threaded stud which extends axially of the slot and outwardly beyond an exterior surface of the fixed jaw. A nut is mounted on the stud portion extending beyond the exterior surface, the nut serving to prevent unclamping movement of the fixed jaw when the nut is screwed along the stud and into contact with the exterior surface.

5 Claims, 1 Drawing Sheet 10
12
14
16
18
20
22
22a
24
26
28
30
32
36
38
42
44
46
52
54
56
58
62
64
68
2
4

ADJUSTABLE END WRENCH INCLUDING MOVABLE JAW LOCKING MEANS

BACKGROUND OF THE INVENTION

This invention relates to adjustable end wrenches having a fixed jaw and an adjustable jaw cooperating with the fixed jaw, and including means for releasably locking the adjustable jaw in fixed, object gripping, position. The invention is particularly useful with end wrenches of the worm gear-rack mechanism type.

Wrenches of the worm gear-rack mechanism type and a particular problem associated therewith are well known. The following three paragraphs are from the introduction of U.S. Pat. No. 4,375,174, Mar. 1, 1983, the subject matter of which is incorporated herein by reference.

Adjustable, parallel jaw end wrenches with worm gear and rack mechanisms have been in general use for probably a hundred years or more. The advantage of such a wrench obviously resides in its ability to take the place of a set of several non-adjustable end wrenches. The adjustable end wrenches have never been a perfect substitute, however, because they tend to back off the object being gripped, especially when a great amount of torque is applied. A stubborn hex head bolt, for example, will often have its corners rounded due to slippage of an adjustable end wrench as one attempts to turn the bolt. Because of the slippage problem, the adjustable, parallel jaw end wrenches in common use today have come to be known as "knuckle busters."

Many attempts have been made over the years to provide adjustable end wrenches with releasable locking mechanisms to prevent them from backing off once they have been tightened on an object. None of the wrenches equipped with such mechanisms appears to have been commercially successful, however. Evidently they have all suffered from one or more of the following drawbacks: too complicated, and therefore too expensive to manufacture; not strong enough to withstand high bending moments; too massive; or requiring too much structural material to be cut away from the wrench, thereby weakening it more than can be tolerated. I have invented a releasable locking mechanism for such a wrench that does not suffer from any of those drawbacks.

The adjustable end wrench which is improved by my locking mechanism is well known in the art. It is comprised of an elongated handle that ends in a fixed jaw portion having a face for engaging one side of an object to be gripped by the wrench; an undercut slot in the fixed jaw portion, the axis of the slot being substantially perpendicular to the plane of the face of the fixed jaw; a movable jaw member having an elongated, protuberant shank portion that mates with the undercut slot and is slidably held in the slot, a face that is opposed to the face of the fixed jaw, and a rack portion that runs parallel to the axis of the slot; an opening, or "window", through the fixed jaw portion adjacent to the slot, the opening being in communication with the slot; and a worm gear rotatably mounted in the opening in driving engagement with the rack portion of the movable jaw member, so that by turning the worm gear one can adjust the distance between the faces of the fixed and movable jaws.

In U.S. Pat. No. 4,375,174, the means for locking the movable jaw comprises a cam mechanism for pushing the gear, and therefore the rack and movable jaw as well, toward the fixed jaw thereby locking the movable jaw in place. A shortcoming of the patent is that it is somewhat complex and expensive. Also, the pressure on the gear by the cam mechanism is a function of the proper dimensioning of the various parts, thereby requiring relatively small manufacturing tolerances. Further, while applicant has not examined an actual wrench according to this patent, it at least appears from the patent that, while locking of the jaws occurs in a direction from jaw to jaw, not a great deal of additional locking is provided with respect to side to side or rotational movements of the movable jaw.

Other patents known to me are U.S. Pat. Nos. 733,617 (Jul. 14, 1903) and 3,093,019 (Jun. 11, 1963), the subject matter of which are also incorporated herein by reference.

In '617, a movable jaw is included which is slightly pivotable with respect to the wrench shank, and set screws are provided for, in special circumstances, locking the movable jaw against the shank to prevent pivoting movement. The wrench of this patent, however, is significantly different from the type of wrenches with which the present invention is concerned, and it is not clear, even if it should occur to skilled workers to use the set screw of this patent, how the set screws of the patent can be used with wrenches of the type improved by my invention.

Patent '019 shows the use of a threaded stud extending from the movable jaw in a direction perpendicular to the shank and a locking nut mechanism for movement along the length of the stud and into engagement with the shank for locking the movable jaw in position. However, the wrench in this patent is also significantly different from wrenches of the type improved by the present invention and it is not clear how the locking nut mechanism (relatively complicated and expensive) can be incorporated in wrenches of the present type.

Also, in both patents '617 and '019, the movable jaw locking means function merely to lock the movable jaw in place while not changing the jaw clamping pressure. In many instances, increasing the maximum clamping pressure obtainable by rotation of the worm gear by the user is desirable.

Accordingly, a need exists in adjustable end wrenches of the worm gear-rack mechanism type for a means, preferably inexpensive and long lasting, for rigidly locking in place, both longitudinally and angularly, the adjustable jaw of the wrench, as well as increasing the clamping pressure as obtained by rotation of the worm gear.

SUMMARY OF THE INVENTION

In an otherwise conventional adjustable end wrench comprising a movable jaw having a shank portion slidably held in a slot through the fixed jaw, means for locking the movable jaw comprises an elongated threaded stud fixedly secured to the shank portion of the movable jaw and extending axially of the slot in a direction from the movable jaw towards the fixed jaw and outwardly beyond an exterior surface of the fixed jaw. A nut is threadedly engaged with the extending end of the stud, whereby, upon screwing of the nut along the stud and into contact with the exterior surface of the fixed jaw, movement of the stud inwardly of the slot is prevented. Because the stud is fixedly secured to the movable jaw, both longitudinal and angular movement of the movable jaw are also prevented. Also upon tightening of the nut against the exterior surface, further tightening of the clamping of the jaws against an object between the jaws is obtained.

DESCRIPTION OF PREFERRED EMBODIMENT OF THE INVENTION

Figures 1, 2, 3, 4:
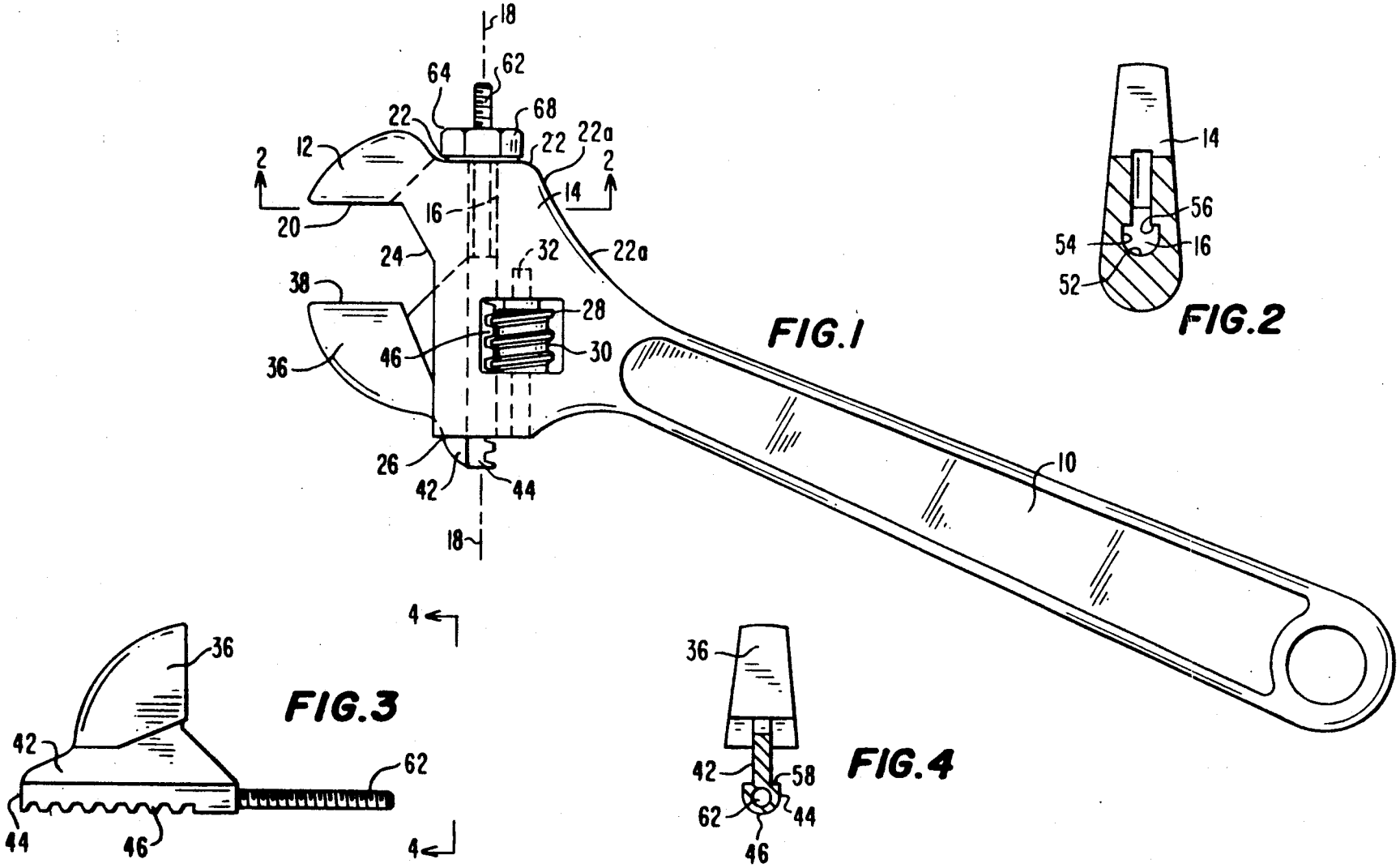
FIG. 1 is a side view of an otherwise conventional adjustable end wrench including a movable jaw locking means in accordance with this invention.
FIG. 2 is a cross-section taken along line 2—2 of FIG. 1, showing a cross-section of the fixed jaw through which a slot extends but not showing portions of the movable jaw disposed, as shown in FIG. 1, within the slot.
FIG. 3 is a side view of the movable jaw separate from the wrench and rotated 90° clockwise from the position of the movable jaw shown in FIG. 1.
FIG. 4 is an end view of the movable jaw taken in the direction of arrows 4—4 of FIG. 3.

The wrench illustrated in the drawings, with the exception of the jaw locking means, is of conventional type and substantially as described in the aforementioned U.S. Pat. No. 4,375,174.

With reference to FIG. 1 herein, the wrench comprises an elongated handle 10 ending in a fixed jaw 12. The fixed jaw 12 is of solid metal and is an integral extension of a head portion 14 of the handle 10. The head portion includes a slot 16 (also FIG. 2) having a main axis 18 extending generally perpendicular to the gripping surface 20 of the fixed jaw 12. The slot 16 comprises a continuous space having an opening or entrance at a top surface 22 of the head portion 14 (as viewed in FIG. 1), an opening 24 along the forward end of the head portion, and an opening at the bottom end 26 of the head portion.

The head portion 14 also includes a square opening 28 therethrough communicating with the slot 16. A worm gear 30 is rotatably mounted within the opening by means of an axle 32 mounted within the head portion 14.

A movable jaw 36 has a gripping surface 38 for cooperating with the gripping surface 20 of the fixed jaw 12. The movable jaw 36 includes (FIG. 3) an elongated shank portion 42 including, on the rearward (FIG. 1) side of the shank portion, a rack portion 44 including spaced apart gear teeth 46. The shank portion 42 extends into the slot 16 through the forward facing opening 24 thereof with the rack teeth meshed with the thread of the worm gear 30.

The cross-sectional shape of the slot 16 in the upper part of the head portion 14 is shown in FIG. 2. The slot 16 includes a rounded bottom wall 52 and side walls 54 including inwardly directed shoulders 56. The cross-sectional shape of the shank 42 of the movable jaw 36 is shown in FIG. 4. Although a cross-sectional view showing the fit of the shank 42 within the slot 16 is not shown, the shank 42 is retained within the slot 16 by engagement of outwardly extending shoulder portions 58 on the shank 42 with the inwardly extending shoulders 56 of the slot walls.

As previously noted, to the extent so far described, the wrench is of conventional design.

For the purpose of locking the movable jaw 36 in position, when the wrench is gripping an object, a threaded stud or bolt 62 is provided fixedly mounted on the shank 42 of the movable jaw 36. The stud 62 (FIG. 3) extends forwardly of the rack portion 44 and is of sufficiently small diameter (FIG. 4) to extend freely through the slot 16 in the head portion 14 (FIG. 1) and outwardly through the slot opening at the upper end 22 of the head portion. A nut 64 is threaded onto the portion of the stud 62 extending beyond the head portion 14. Preferably, the upper surface 22 of the head portion 14 is flat and perpendicular to the main axis 18 of the slot 16. Also, as is common, the nut 64 has flat surfaces 68 disposed perpendicularly to the stud 62 axis.

In the condition illustrated in FIG. 1, the nut 64 is in contact with the upper surface 22 of the head portion 14. Accordingly, because the stud 62 is fixedly secured to the jaw 36, movement of the jaw 36 in a direction away from the jaw 12 is prevented. Conversely, in the absence of an object gripped between the jaws 36 and 12, the jaw 36 can be moved, by rotating the worm gear 30, towards the jaw 12. Also, when the nut 64 is firmly in contact with the surface 22, rotation of the stud about its longitudinal axis is prevented thereby preventing movement of the movable jaw in directions transverse to the direction from jaw to jaw.

In use of the wrench to grip an object between the jaws 12 and 36, the nut 64 on the stud 62 is first screwed along the stud in a direction away from the head portion 14 to ensure that the jaws 12 and 36 can be sufficiently separated to allow envelopment of the object between the two jaws. Then, the worm gear 30 is rotated to close the jaw 36 onto the object and to clamp it between the two jaws 36 and 12. Then, preferably while the user's finger is held on the worm gear 30 to prevent reverse rotation thereof and loosening of the clamping of the object, the nut 64 is screwed along the stud 62 into engagement with the head portion 14.

As previously mentioned, this prevents opening movement of the jaw 36 as well as preventing side to side movement thereof, whereby the jaw is locked in place for maintaining the clamping of the object even after the user's hand is removed from the wrench. Also, upon tightening of the nut 64 against the head portion surface 22, the stud 62 is urged in a direction away from the head portion thereby urging the jaw 36 towards the jaw 12. This further tightens the clamping of the object between the jaws.

If desired, the nut 64 can be further tightened by means of an open-ended wrench or the like. The nut 64 is readily accessible to such tightening tool, particularly in a direction from the handle 10 end of the wrench, because the nut 64 is disposed exteriorly of the head portion 14, and because the flat surface 22 at the upper end of the head portion terminates, on the handle side of the head portion, with a surface **22*a* which falls away from the surface 22** in a direction towards the lower end of the head portion.

The wrench can be unclamped from the object by screwing the nut 64 away from the head portion 14.

Advantages of the locking mechanism described herein are that it is extremely simple both in structure and operation. Also, because the movement of the nut 64 along the stud 62 is "infinitely" adjustable, quite standard manufacturing tolerances for the stud and nut can be used while still obtaining perfect locking for any setting of the jaws 36 and 12. Reduced wear of the parts and firmer locking of the jaw 36 both longitudinally and angularly is obtained by the flat, surface to surface contact between the nut surface 68 and the head portion surface 22.

In comparison with the mechanism described in the aforementioned U.S. Pat. No. 4,375,174, wherein the worm gear is moved for moving and locking the movable jaw, the reverse occurs in the present wrench. That is, the movable jaw is moved directly by the tightening of the nut 64 against the head portion 14, thereby moving the worm gear. Further, in the patent, increased locking of the movable gear in side to side (angular) directions is provided by the increased friction between the worm gear thread and the rack teeth caused by the axial pressure. Such increased gear to rack friction is also provided in the inventive wrench when the movable jaw is axially tightened against the worm gear. However, in addition to such increased friction between the worm gear and the rack teeth, additional locking against side to side movement not present in the patent mechanism is provided by the friction between the nut 64 and the head portion surface 22.

What is claimed is:

1. An adjustable end wrench comprising an elongated handle terminating in a head portion from which a fixed jaw extends and including a slot extending entirely through the head portion along an axis, a movable jaw having a shank portion slidably retained in the slot allowing movement of the movable jaw in a direction parallel to said axis towards and from the fixed jaw, the slot through the head portion having an opening in an exterior surface of said head portion, said slot opening comprising an end of said slot towards which said shank portion moves during movement of said movable jaw towards said fixed jaw, a threaded stud mounted on said shank portion extending axially of said slot and outwardly of said slot through said opening thereof, a nut threadedly mounted on the outwardly extending portion of said stud for engaging said head portion exterior surface, said shank portion including a rack portion within said slot and extending along the axis thereof, said head portion having a window therethrough adjacent to and in communication with said slot, and a worm gear rotatably mounted within said window in driving engagement with said rack portion.

2. A wrench according to claim 1 wherein said nut is movable with said stud for movements along said axis relative to said fixed jaw.

3. A wrench according to claim 1 wherein said exterior surface of said head portion is flat and disposed generally perpendicular to said slot axis, and said nut has an exterior side surface which is flat and which is disposed generally perpendicular to said slot axis, whereby said nut engages said exterior surface in a flat surface to surface contact.

4. A wrench according to claim 3 wherein said flat exterior surface of said head portion joins a surface of said head portion extending towards said handle, said extending surface falling away from said flat surface in a direction towards said movable jaw for providing access to said nut by a nut tightening tool in a direction from said handle.

5. An adjustable wrench having a head portion comprising a fixed jaw extending from said head portion and a movable jaw with the movable jaw being advanced toward or away from the fixed jaw by means of a worm gear rotatably mounted within said head portion, means for firmly securing and clamping by the two jaws of an object disposed therebetween comprising:

a threaded stud mounted on said movable jaw and extending through said fixed jaw, said stud having a portion extending beyond an outer surface of the fixed jaw; and a nut threadedly mounted on the portion of the stud extending beyond the outer surface of the fixed jaw for engaging the outer surface of said fixed jaw for clamping said movable and fixed jaws against an object disposed between them.

* * * * *